United States Patent [19]

Nakamura et al.

[11] Patent Number: 4,920,905

[45] Date of Patent: May 1, 1990

[54] DETECTOR FOR USE ON SEWING MACHINES

[75] Inventors: Takashi Nakamura; Yutaka Yamaura, both of Aichi, Japan

[73] Assignee: Mitsubishi Denki Kabushiki Kaisha, Aichi, Japan

[21] Appl. No.: 396,182

[22] Filed: Aug. 21, 1989

Related U.S. Application Data

[63] Continuation of Ser. No. 223,736, Jul. 15, 1988, which is a continuation of Ser. No. 491,970, filed as PCT JP82/00262 on Jul. 10, 1982, abandoned.

[30] Foreign Application Priority Data

| | | | |
|---|---|---|---|
| Jul. 10, 1981 | [JP] | Japan | 56-107866 |
| Jul. 10, 1981 | [JP] | Japan | 56-102701 |
| Jul. 10, 1981 | [JP] | Japan | 56-102702 |
| Jul. 10, 1981 | [JP] | Japan | 56-102703 |

[51] Int. Cl.[5] ..... D05B 69/24

[52] U.S. Cl. ..... 112/275; 318/467; 250/233

[58] Field of Search ..... 112/275, 277, 300, 67, 112/87, 220, 221; 250/231 SE, 233, 230; 318/467, 275

[56] References Cited

U.S. PATENT DOCUMENTS

| | | | |
|---|---|---|---|
| 3,573,581 | 4/1971 | Dutko et al. | 112/275 X |
| 3,683,294 | 8/1972 | Gaa | 112/275 X |
| 3,738,297 | 6/1973 | Sangiorgi | 112/275 |
| 4,463,698 | 8/1984 | Shinozaki et al. | 112/275 |
| 4,584,954 | 4/1986 | Soyama et al. | 112/275 |

FOREIGN PATENT DOCUMENTS

| | | | |
|---|---|---|---|
| 2848612 | 2/1980 | Fed. Rep. of Germany | 112/275 |
| 2155570 | 5/1973 | France | 112/275 |
| 55-66388 | 5/1980 | Japan | 112/275 |

*Primary Examiner*—Peter Nerbun

*Attorney, Agent, or Firm*—Sughrue, Mion, Zinn, Macpeak & Seas

[57] ABSTRACT

One or a plurality of photoelectric detector plates are mounted on a coupling fixed to an arm shaft of a sewing machine, and have predetermined light shields. A light-emitting means is disposed on one side of the photoelectric detector plates for emitting light toward the photoelectric detector plates, and a photodetector means is disposed on the other side of the photoelectric detector plates for receiving the light emitted from the light-emitting means. Conditions of the sewing machine can be detected by the manner in which the photodetector means receives the light.

4 Claims, 3 Drawing Sheets

DETECTOR FOR USE ON SEWING MACHINES

This is a continuation, of application Ser. No. 07/223,736, filed Jul. 15, 1988, which is a continuation of application Ser. No. 06/491,970 filed as PCT JP82/00262 on Jul. 10, 1982, now abandoned.

TECHNICAL FIELD

The present invention relates to a detector for use on a sewing machine, and more particularly to a sewing machine detector mounted on a sewing machine arm shaft.

BACKGROUND ART

There are known sewing machines such as those for industrial use in which various modes of stitching control are automatically effected. It is necessary in such sewing machines that a pulse generator for speed control, that is, a pulse generator for detecting the speed of rotation of an arm shaft of the sewing machine be provided, and detection be made of an upper needle position, a lower needle position, and a timing for cutting off a needle thread. For such detection, there has conventionally been employed a detector comprising a magnetized ring magnet and a Hall-effect element, the ring magnet being secured to the sewing machine arm shaft.

In order to carry out reliable detection, the ring magnet of the prior detector is required to be relatively large in size, particularly thick, and hence the detector per se is of a large size. Due to a large moment of inertia, the detector is disadvantageous in that its rotatable part or magnet tends to be damaged especially when used on high-speed sewing machines which have become available in recent years. Another difficulty with the conventional detector is that the detecting position and the like of the detector cannot easily be adjusted or otherwise changed dependent on the type or mode of use of the sewing machine.

DISCLOSURE OF THE INVENTION

The present invention has been made in view of the foregoing prior problems. It is an object of the present invention to provide a detector for use on sewing machines which is small in size, lightweight, capable of detection with high accuracy, and has its detecting position easily adjusted.

To achieve the above object, there is provided according to the present invention a detector for use on a sewing machine, comprising a coupling secured to an arm shaft of the sewing machine, a base supported on the coupling and having one end engaging a body of the sewing machine and held at rest in a given position, a plurality of photoelectric detector plates coaxially mounted in axially successive layers on the coupling and slippingly rotatable thereon, the photoelectric detector plates having light shields disposed concentrically so as not to be overlapped, and light-emitting and photodetector means fixed to the base and arranged one on each side of the set photoelectric detector plates.

BEST MODE FOR CARRYING OUT THE INVENTION

A preferred embodiment of the present invention will be described hereinbelow with reference to the drawings.

Figure 1:
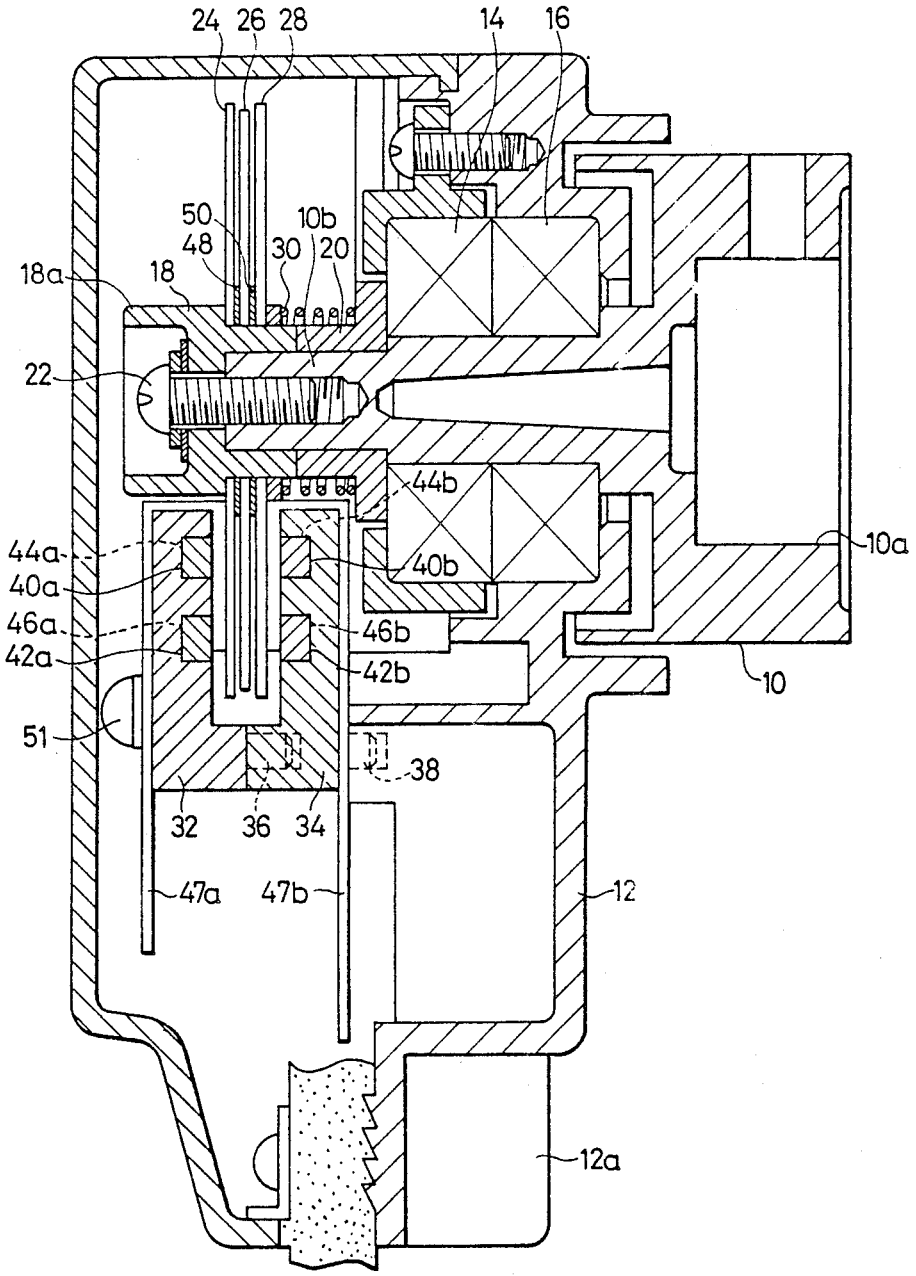
FIG. 1 is a cross-sectional view of a detector for use on a sewing machine according to the present invention.

FIG. 1 shows in cross section a detector for use on a sewing machine according to the present invention.

As shown in FIG. 1, a sewing machine detector includes a coupling 10 having one end 10*a* fixed to a sewing machine arm shaft (not shown) and a base 12 supported on the coupling 10 and having one end 12*a* engaging a sewing machine body (not shown) and held at rest in a given position. There are bearings 14, 16 through which the coupling 10 and the base 12 are interconnected, the coupling 10 being rotatable in the base 12 by the bearings 14, 16.

Figure 5:
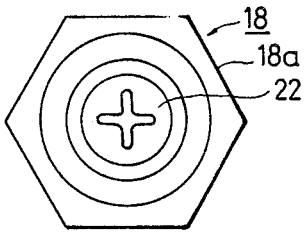
FIG. 5 is a side elevational view of a distal end of a collar.

The coupling 10 also has a distal end 10*b* over which are fitted collars 18, 20 that are separated axially of the coupling 10 and slippingly rotatable, the collars 18, 20 being fastened to the coupling 10 by a screw 22. As show in FIG. 5, the collar 18 has a distal end of a polygonal peripheral shape. Three photoelectric detector plates 24, 26, 28 are coaxially removably secured to the collar 18 and arranged in successive layers axially of the coupling 10. The photoelectric detector plates 24, 26, 28 are pressed by a compression spring 30 having one end engaged by the collar 20. The end detector plates 24, 28 are slippingly rotatable while the intermediate detector plate 26 is disposed nonrotatably on the collar 18. The photoelectric detector plates 24, 28 can rotate independently of one another. Furthermore, by rotating the collar 18 after loosening the screw 22, all of the photoelectric detector plates 24, 26, 28 can simultaneously be rotated with respect to the coupling 10. The collar 20 serves to engage the end of the spring 30 and also to prevent the coupling 10 from being pulled out of the bearings 14, 16.

Figure 2:
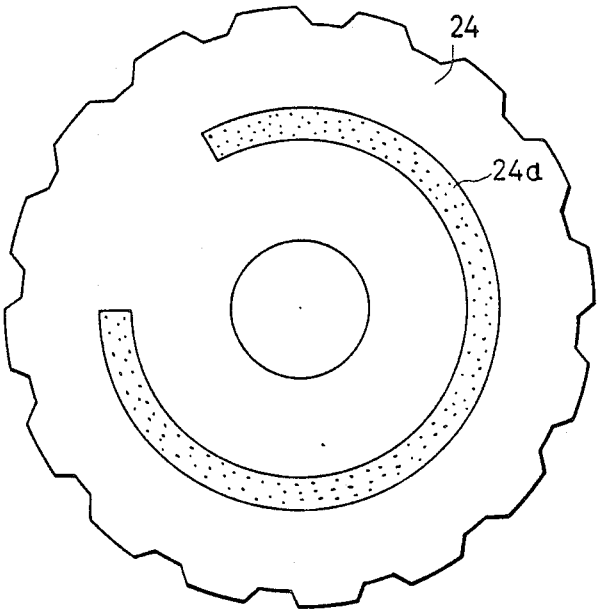
FIGS. 2, 3 and 4 are side elevational views of photoelectric detector plates, respectively.
Figure 3:
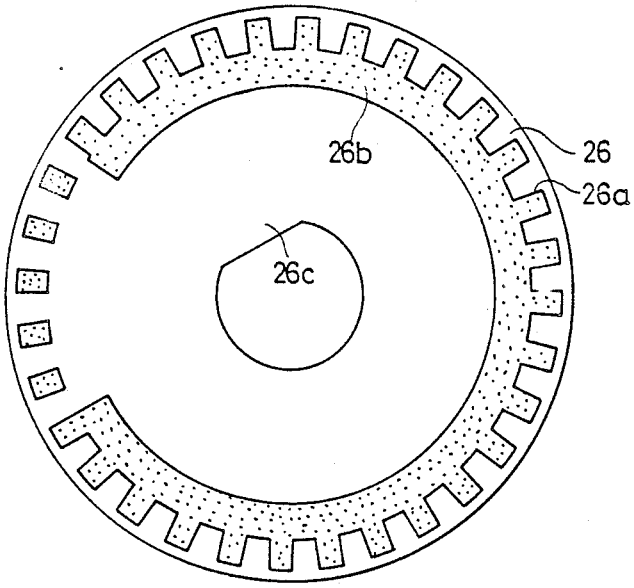
Figure 4:
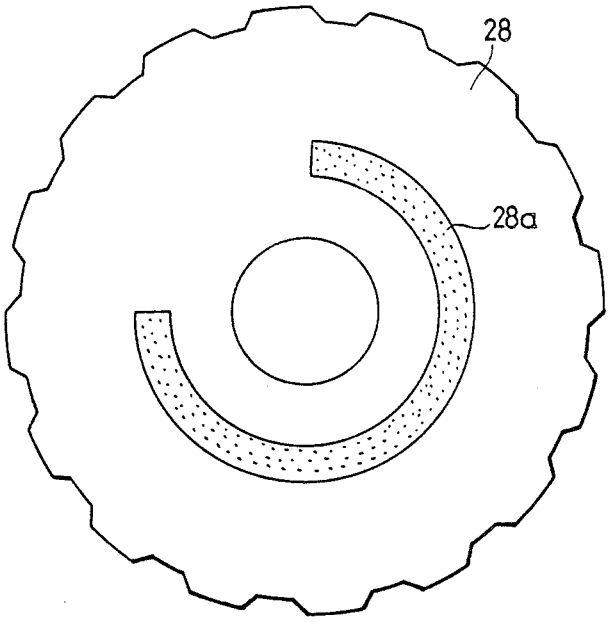

FIGS. 2, 3 and 4 illustrate the photoelectric detector plates 24, 26, 28, respectively.

In FIGS. 2, 3 and 4, the photoelectric detector plate 24 serves to detect a lower needle position, the photoelectric detector plate 26 serves to cooperate with a pulse generator for detecting the speed of rotation of the sewing machine arm shaft and also to detect an upper needle position, and the photoelectric detector plate 28 serves to detect a timing for cutting off a needle thread, the photoelectric detector plates 24, 26, 28 being made of transparent material capable of transmitting light therethrough. Light shields 24*a*, 26*a*, 26*b*, 28*a* are marked as by printing on the photoelectric detector plates 24, 26, 28, respectively, in concentric relation so as not to be overlapped. The light shields 24*a*, 26*a*, 26*b*, 28*a* are effective to detect the lower needle position, the rotation of the sewing machine arm shaft, the upper needle position, and the timing for cutting off the needle thread, respectively. In FIGS. 2, 3 and 4, the light shields 24*a*, 26*a*, 26*b*, 28*b* on the photoelectric detector plates 24, 26, 28 are colored with different colors such for example as red, black, and blue to suit desired applications. As illustrated in FIG. 3, the photoelectric detector plate 26 has a rotation stop 26*c* by which the photoelectric detector plate 26 is secured nonrotatably in position on the collar 18. Instead of employing the collars 18, 20, the intermediate photoelectric detector plate 26 may be of an inside diameter selected such that the plate 26 frictionally engages the coupling 10, and the photoelectric detector plates 24, 28 may of an inside diameter selected such that they will loosely fit over the coupling 10. With this arrangement, the photoelectric detector plates 24, 28 can rotate separately, and all of the photoelectric detector plates 24, 26, 28 can rotate simultaneously with respect to the coupling 10 without loosening the screw 22. As shown in FIG. 1, a pair of sensor blocks 32, 34 are provided one on each side of the set of photoelectric detector plates 24, 26, 28. The sensor block 32 is affixed to base 12 b a sensor positioning projection 38.

The sensor block 34 is fastened to the base 12 by a screw 12. The sensor block 32 has light-emitting devices 40*a*, 42*a*, 44*a*, 46*a* on a surface thereof facing the photoelectric detector plte, and the sensor block 34 has on a surface thereof facing the photoelectric detector plate photodetectors 40*b*, 42*b*, 44*b*, 46*b* which are located in axial alignment with the light-emitting devices 40*a*, 42*a*, 44*a*, 46*a*, respectively. The sensor block 32 has a printed-circuit board 47*a* on which desired circuits of the light-emitting devices 40*a*, 42*a*, 44*a*, 46*a* are formed, and the sensor block 34 has a similar printed-circuit board 47*b*.

According to the embodiment of the present invention, desired detections on the sewing machine are made by means of the photoelectric detector plates 24, 26, 28 and the four light-emitting devices 40*a*, 42*a*, 44*a*, 46*a* and the four photodetectors 40*b*, 42*b*, 44*b*, 46*b*.

Figure 6:
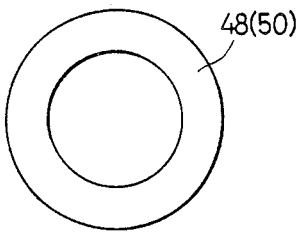
FIG. 6 is a front elevational view of a spacer.
Figure 7:
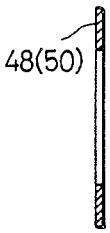
FIG. 7 is a cross-sectional view of the spacer.

Spacers 48, 50 are interposed respectively between the photoelectric detector plates 24, 26 and between the photoelectric detector plates 26, 28. As illustrated in FIGS. 6 and 7, each of the spacers is ring-shaped and has a thickness of 250 microns, for example. The spacers 48, 50 are effective to prevent oil or the like from entering the gaps between the photoelectric detector plates 24, 26 and between the photoelectric detector plates 26, 28,and also to prevent the photoelectric detector plates, particularly the light shields, from being subjected to damage which would otherwise occur by frictional contact or the like between the detector plates, to thereby protect the photoelectric detector plates.

The detector on the sewing machine according to the present invention is of the foregoing construction, and its operation will now be described.

In FIG. 1, photoelectric detector plates 24, 26, 28 that are selected dependent on the type of a sewing machine used or a mode of use thereof are mounted as successive layers on the collar 18. When the coupling 10 fixed to the sewing machine arm shaft is rotated, the photoelectric detector plates 24, 26, 28 are rotated, thus intermittently shielding light emitted from the light-emitting devices 40*a*, 42*a*, 44*a*, 46*a* with the light shields 24*a*, 26*a*, 26*b* 28*b*. The intermittent beams of light are received by the photodetectors 40*b*, 42*b*, 44*b*, 46*b* for effecting desired detection.

With this embodiment, the photoelectric detector plates 24, 28 can slippingly rotate independently of each other with respect to the collar 18, so that the light shields 24*a*, 28*a* on the photoelectric detector plates 24, 28 can be adjusted in desired angular positions with respect to the coupling 10. Although the photoelectric detector plate 26 is nonrotatably secured to the collar 18, since the latter can be rotated by loosening the screw 22, all of the photoelectric detector plates 24, 26, 28 can simultaneously be rotated with respect to the coupling 10 so that the light shields 24*a*, 26*a*, 26*b*, 28*a* on the photoelectric detector plates 24, 26, 28 can be adjusted into given angular positions, respectively, at the same time with respect to the coupling 10. The collar 18 can be removed by loosening the screw 22, allowing the photoelectric detector plates 24, 26, 28 to be replaced with another set to meet the sewing machine type or mode of use of the sewing machine. Therefore, photoelectric detector plates having desired light shields can be attached to the sewing machine detector.

According to the foregoing embodiment, since the photoelectric detector plates 24, 28 do not suffer from any problem if they are of a reduced thickness, a feature different with conventional ring magnets, the photoelectric detector plates can be lightweight and small in size, and hence the detector can bodily be small in size and lightweight without lowering the reliability of its detecting operation. With the photoelectric detector plates 24, 28 being small in size and lightweight, their moment of inertia is quite small, and there is no tendency for rotatable parts to be mechanically damaged in high-speed sewing machines which have become available in recent years. As described above, simultaneous positional adjustment of the photoelectric detector plates 24, 28 with the capability of positional adjustment of the photoelectric detector plate 24 independently enables a detection operating point to be adjusted with ease. Since the photoelectric detector plates 24, 28 together with the collar 18 are readily removable for replacement, the detector can easily be suited for the type of the sewing machine used and the mode of use of the latter.

Rather than employing the collars 18, 20, the photoelectric detector plates 24, 28 may directly be fitted over the coupling shaft 10 for adjusting their angular positions through slipping rotation. Only a single photoelectric detector plate may suffice with optical marks put on the face and back of the disc. The unreflective surface and the reflective surfaces (light shields) on the photoelectric detector plate may be switched around so that they may be in reversed relation to those in the illustrated embodiment.

According to the embodiment, the spacers 48, 50 are disposed respectively between the photoelectric detector plates 24, 26 and between the photoelectric detector plates 26, 28. Because the spacers can prevent oil and the like from entering the gaps between the photoelectric detector plates 24, 26 and between the photoelectric detector plates 26, 28, the photoelectric detector plates are kept transparent. The spacers can also prevent the photoelectric detector plates, especially the light shields from any damage which would result from frictional contact between the detector plates, for thereby protecting the photoelectric detector plates.

With the present embodiment, the light shields 24*a*, 26*a*, 26*b*, 28*a* on the photoelectric detector plates 24, 26, 28 have different colors to meet desired applications, so that the photoelectric detector plates can easily be identified and the desired photoelectric detector plates can properly be judged when the photoelectric detector plates 24, 26, 28 are to be adjusted into given angular positions with respect to the coupling 10.

The collar 18 which is slippingly rotatable and has the polygonal, such as hexagonal or square, distal end 18*a* is mounted on the distal end 10*b* of the coupling 10, and the photoelectric detector plates 24, 26, 28 are mounted on the collar 18. This arrangement allows the distal end 18*a* of the collar to fit in a tool such as a wrench for fine positional adjustment of the collar 18 without touching the transparent portions of the photoelectric detector plates 24, 26, 28.

With the present invention, as described above, there is provided a detector for use on a sewing machine, which is small in size and lightweight, capable of detection with high accuracy, and has a detecting position easily adjustable.

What is claimed is:

1. A detector for use on a sewing machine, comprising a coupling secured to an arm shaft of the sewing machine, a base supported on the coupling and having one end engaging a body of the sewing machine and held at rest in a given position, a collar fitted over said coupling, a spring fitted over said collar, a plurality of photoelectric detector plates coaxially mounted removably in an axial direction on the coupling, each of said plurality of photoelectric detector plates having at least one light shield, said detector further comprising means for releasably holding said photoelectric detector plates on said coupling, the spring providing tension between the photoelectric detector plates and the collar so that the attachment of the photoelectric detector plates enables adjustment of all the photodetector plates into a given angular position with respect to the coupling through loosening of the securing means, at least one of the photoelectric detector plates being angularly adjustable with respect to the coupling when said securing means is tightened, the light shields on said plurality of photoelectric detector plates being arranged concentrically so that no one of the light shields overlaps any of the other light shields, and light-emitting and photodetector means fixed to the base and disposed one on each side of the plurality of photoelectric detector plates, each of said light-emitting and photodetector means being at least two in number and mounted on one and the same plane.

2. A detector according to claim 1, wherein one of said photoelectric detector plates has a light shield for a pulse generator for detecting a speed and a light shield for detecting a needle position.

3. A detector according to claim 1 or 2, wherein the light shields on the photoelectric detector plates have different colors to suit a particular application, so that the photoelectric detector plates can easily be identified when the photoelectric detector plates are to be adjusted into given angular positions with respect to the coupling.

4. A detector according to claim 1, wherein at least one of said photoelectric detector plates has a plurality of light shields disposed thereon.

* * * * *